US006956479B2

(12) United States Patent
Kelsch et al.

(10) Patent No.: US 6,956,479 B2
(45) Date of Patent: Oct. 18, 2005

(54) SENSORS AND METHODS FOR DETECTING ATTACHMENT TO A SURFACE

(75) Inventors: Christopher A. Kelsch, Palm Harbor, FL (US); John N. Figh, Jr., Valrico, FL (US); D. Scott Kalous, Gurnee, IL (US)

(73) Assignee: Vanguard Products Group, Inc., Tampa, FL (US)

( * ) Notice: Subject to any disclaimer, the term of this patent is extended or adjusted under 35 U.S.C. 154(b) by 156 days.

(21) Appl. No.: 10/358,936

(22) Filed: Feb. 5, 2003

(65) Prior Publication Data

US 2004/0150523 A1 Aug. 5, 2004

(51) Int. Cl.[7] ..... G08B 13/14

(52) U.S. Cl. ..... 340/568.1; 340/568.2; 340/568.4

(58) Field of Search ..... 340/568.1, 568.2, 340/539.31, 687, 572.9, 568.4

(56) References Cited

U.S. PATENT DOCUMENTS 4,772,878 A * 9/1988 Kane ..... 340/568.4
6,087,939 A * 7/2000 Leyden et al. ..... 340/568.2
6,570,502 B2 * 5/2003 Matsuo ..... 340/568.2
6,756,900 B2 * 6/2004 Leyden et al. ..... 340/568.4

OTHER PUBLICATIONS

*International Search Report*; Sep. 24, 2004; 3 pages.

*Written Opinion of the International Searching Authority*; Sep. 24, 2004; 6 pages.

* cited by examiner

*Primary Examiner*—John Tweet, Jr.
(74) *Attorney, Agent, or Firm*—Hanley, Flight, & Zimmerman, LLC

(57) ABSTRACT

Sensors and methods for detecting attachment to a surface are disclosed. The sensors include a housing having an inner surface, an outer surface and a passage extending through the housing. An elongated member or fastener extends though the passage and protrudes from the outer surface of the housing to attach the sensor to a surface. First and second electrical contacts are disposed within the housing so that when the sensor is attached to the surface an electrical path is formed between the first and second electrical contacts.

42 Claims, 5 Drawing Sheets

SENSORS AND METHODS FOR DETECTING ATTACHMENT TO A SURFACE

FIELD OF THE DISCLOSURE

The present invention relates generally to sensors and, more specifically, to sensors and methods that may be used to detect attachment of a device to a surface.

BACKGROUND

Sensors for detecting attachment to a surface are generally well known. For example, retail businesses that sell consumer goods, particularly expensive hand-held or portable electronic goods such as cameras, personal data assistants, laptop computers, calculators, camcorders, etc., use security sensors that detect removal of such an item from a point-of-purchase display area. The cable or tether enables a consumer to physically examine and test a hand-held, portable electronic product, the product is typically fixed to a tether or cable, which may be retractable, that enables the consumer to examine the product only in close proximity to the display area and prevents the consumer from removing the product from the display area. In some cases, the tether or cable provides power and/or other signals to the product. Often, the tether or cable also includes one or more wires or signal lines that connect to a security sensor at the product end of the tether or cable. Known security sensors are typically momentary switches encased in a housing that provide a push-button or the like protruding from an outer surface of the housing. Such push-button actuated security sensors are typically adhered via double-sided tape to a surface of the product being protected so that the push-button is depressed to maintain the switch contacts in a closed condition while the security sensor remains attached to the product. If the security sensor is removed from the product, the switch contacts move to an open condition.

Typically, the switch contacts are electrically connected to a remote security unit via signal lines traveling through the tether or cable. In the event the remote security unit detects that the switch contacts are in an electrically open condition (i.e., the current path between the contacts has been interrupted or broken), an alarm or other indication may be produced to alert security personnel, store managers, owners, etc. that a product may have been removed from the display area.

Unfortunately, retail theft of hand-held or portable electronic goods is a pervasive problem and the above-described known security sensors are relatively easy to circumvent or defeat. In general, known security sensors and switches use an attachment mechanism (e.g., double-sided tape) that is functionally independent from the switching or sensing mechanism. As a result of this functional independence, a thief can more easily disable or circumvent the switching or sensing mechanism before removing the security sensor from the product. For instance, a momentary switch-based security sensor that is attached to a product can be removed without detection by sliding a knife or other thin, flat object between the push-button and the product and using the knife or other object to maintain the push-button in a depressed or fully-actuated condition while removing the security sensor from the product.

DETAILED DESCRIPTION

Figure 1:
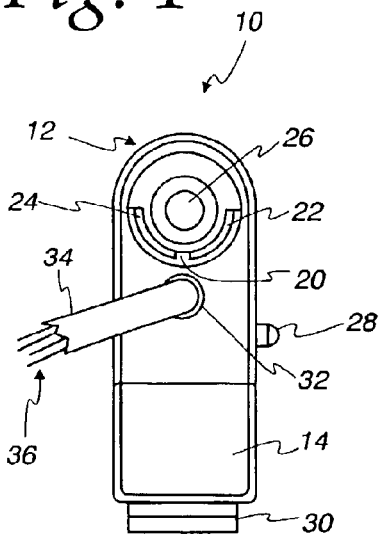
FIG. 1 is a plan view of a top side of an example sensor for detecting attachment to a surface.
Figure 2:
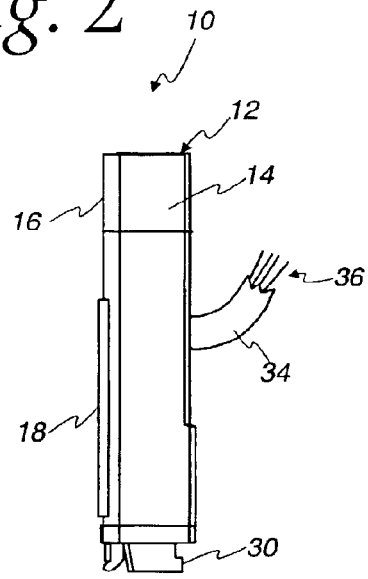
FIG. 2 is a side view of the example sensor shown in FIG. 1.

FIGS. 1 through 4 depict an example sensor 10 for detecting attachment to a surface. The sensor 10 includes a housing 12 having a first portion 14 and a second portion 16 that are joined together, an adhesive layer 18 for adhering the sensor to a surface and a circuit board 20 having first and second electrical contacts 22 and 24. The sensor 10 also includes a passage 26 extending through the housing 12 that is sized to accommodate a fastener or other elongated member for mechanically attaching the sensor 10 to a surface and for forming an electrical switch with the contacts 22 and 24 and an attachment indicator 28 for providing a visual indication that the sensor 10 is attached to a surface. Still further, the sensor 10 includes a connector 30 for providing power and/or other signals to a device associated with the surface and an opening 32 through which an electrical cable 34 having a plurality of electrical conductors or signal lines 36 passes. The signal lines 36 may include various power supply voltages, which may be routed through the circuit board 20 to the connector 30, a signal(s) to activate the attachment indicator 28, electrical connections to the contacts 22 and 24, or any other desired signals.

The housing 12 is preferably made of a thermoplastic material such as Acrylonitrile-butadine-styrene (ABS) to provide suitable environmental ruggedness at a relatively low cost. The first and second portions 14 and 16 of the housing 12 are joined together using glue, ultrasonic welding and/or mechanical fasteners such as screws (not shown). The adhesive layer 18 is a doubled-sided tape having a thickness of about 0.045 inches that is selected to provide suitable adhesion to the housing 12 and to a variety of plastic and metal surfaces such as those typically associated with the outer surfaces of hand-held consumer electronic products (e.g., cameras, laptop computers, PDAs, etc.). The opening 32 is sized to accommodate a cable (e.g., the cable 34) having a plurality of conductors and a grommet (not shown) or other strain relief feature or device for preventing breakage of the cable 34 and/or ones of the plurality of wires 36.

The circuit board 20 is a conventional single-sided or multi-layer printed circuit board having the contacts 22 and 24 formed integrally thereon. As described in greater detail below, the contacts 22 and 24 are arranged adjacent to the passage 26 so that when a fastener or other elongated member is disposed in the passage 26 to fasten the sensor 10 to a surface, an electrical path is formed between the contacts 22 and 24 via the fastener or other elongated member.

The attachment indicator 28 is preferably a light-emissive device such as a light-emitting diode that receives a signal via the cable 34 that causes the indicator to illuminate when the sensor 10 is not attached to a surface. The connector 30 is optionally included to enable the sensor 10 to provide power and/or other signals to an electronic device associated with the surface to which the sensor 10 is attached. For example, in the case where the sensor 10 is attached to a hand-held, portable electronic device such as a video camera, power signals may be provided by a remote power source via the cable 34 and the connector 30 to the video camera. The connector 30 is preferably a de-pluggable or removable modular connector having multiple termination positions. In this manner, the connector 30 facilitates the adaptation of the sensor 10 to the requirements of different types of electronic devices to which the sensor 10 may be attached. For example, a video camera may require one power supply voltage, which is supplied via one pair of terminals associated with the connector 30, while a digital camera requires a different power supply voltage, which is supplied by a different pair of terminals associated with the connector 30. As discussed in greater detail below, in the example sensor 10 shown in FIGS. 1 through 4, the optional connector 30 provides four terminal positions, one of which is a common ground connection and the other three of which provide three different direct current (DC) voltages, each of which may be used to supply power to a different type of electronic device. Of course, the connector 30 can be omitted or, if desired, could have more or fewer terminals supplying any desired variety of power signals or other signals to suit a particular application.

Figure 5:
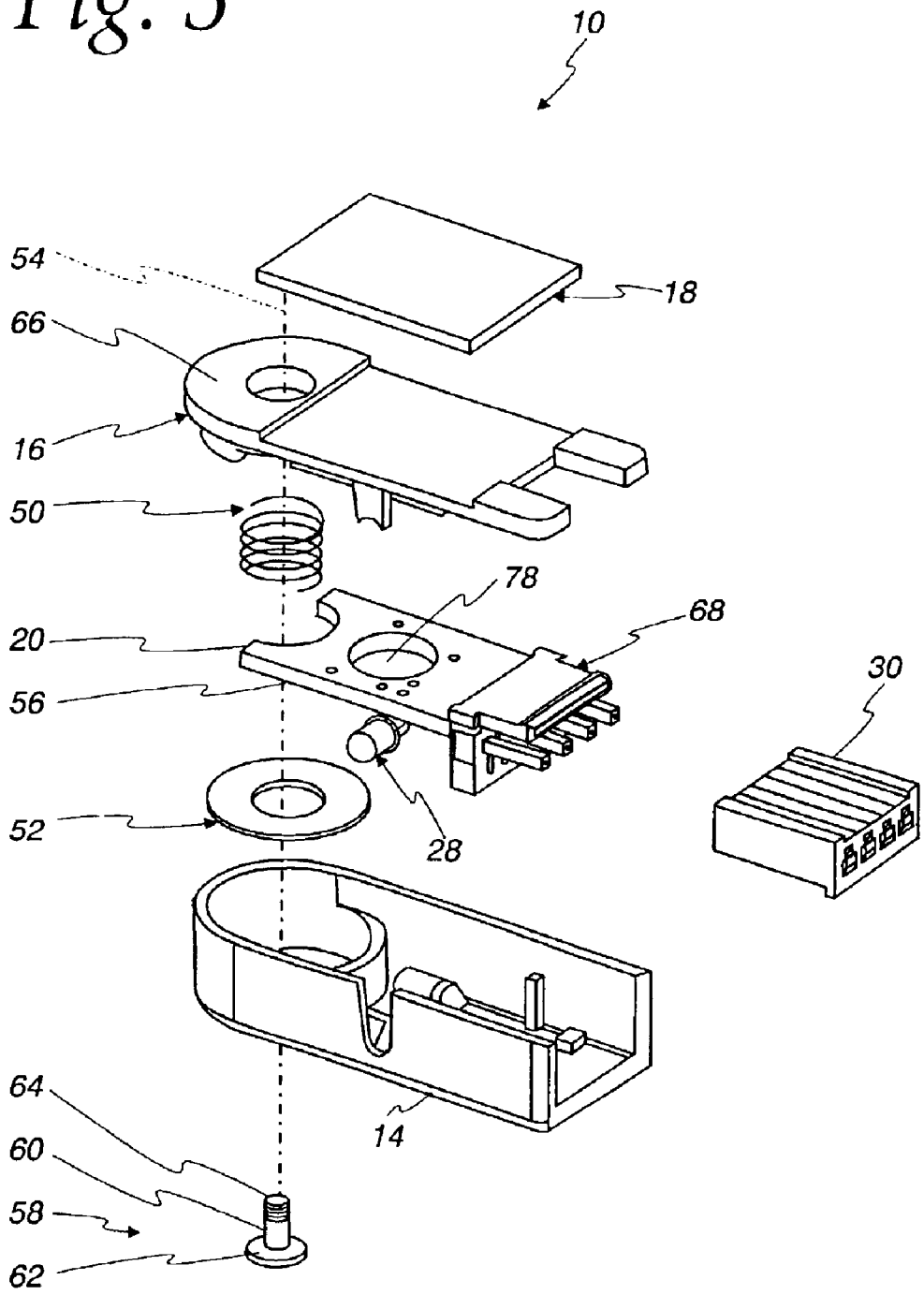
FIG. 5 is an exploded isometric assembly view of the example sensor shown in FIG. 1.

FIG. 5 is an exploded isometric assembly view of the example sensor 10 shown in FIG. 1. As shown in FIG. 5, the sensor 10 further includes a spring 50, which in the example of FIG. 5 is wound in a coil spring configuration and a washer 52, both of which are approximately coaxially aligned with an axis 54 of the passage 26. When the sensor 10 is assembled, the spring 50 urges the washer 52 away from the circuit board 20 and, thus, the contacts 22 and 24 (which are located on a surface 56 that is more clearly shown in FIG. 6) so that there is no electrical path (i.e., conductivity) between the contacts 22 and 24.

On the other hand, when the sensor 10 is attached to a surface, an elongated member 58 is disposed in the passage 26. In the example shown in FIG. 5, the elongated member 58 is a fastener such as a screw or a bolt having an elongated portion 60 and a head portion 62. The elongated member 58 may be made from a conductive material or a non-conductive material. The elongated portion 60 includes a fastening portion 64 that extends through the passage 26 along the axis 54 and protrudes from an outer surface 66 of the housing 12. Preferably, the fastening portion 64 is threaded for engagement with a blind hole or other suitable receiving feature associated with the surface (e.g., the surface of a product, object, etc.) to which the sensor 10 is attached (not shown). When the sensor 10 is attached to a surface, the head portion 62 of the elongated member 58 drives the washer 52 against the force of the spring 50 to cause the washer to engage with the contacts 22 and 24. This engagement forms an electrical path through the contacts 22 and 24 via the washer 52 and, in the case where the elongated member 58 is made of a conductive material such as steel, via the elongated member 58. Of course, in the case where the elongated member 58 is made of a non-conductive material (e.g., nylon), the elongated member 58 does not form part of the electrical path between the contacts 22 and 24.

A four pin male connector 68 is fixed to the circuit board 20. The male connector 68 is adapted to mate with and retain the female connector 30. The male connector 68 routes a common ground signal and three different power supply voltages from the circuit board 20 to the female connector 30. Of course, the male connector 68 (and the female connector 30) may be eliminated if the device to which the sensor 10 is attached does not require power or obtains power from another source (e.g., an internal battery). The male connector 68 may have more or fewer pins as needed to convey more or fewer signals to the female connector 30.

Figure 6:
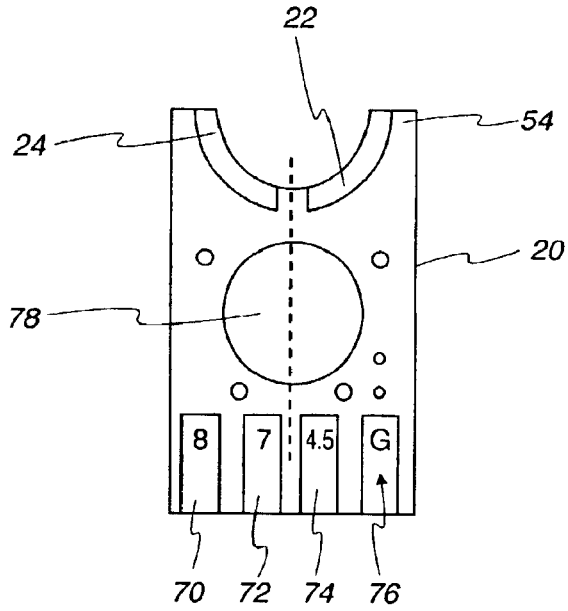
FIG. 6 is a detailed plan view of the circuit board shown in FIGS. 1 and 5.

FIG. 6 is a detailed plan view of the circuit board 20 shown in FIGS. 1 and 5. As depicted in FIG. 6, the first and second electrical contacts 22 and 24 are arranged on the surface 54 of the circuit board 20 adjacent to the passage 26. Thus, the contacts 22 and 24 are positioned to provide an electrical path through the washer 52 when the elongated fastener or member 58 is disposed in the passage 26 and urges the washer 52 into contact with the surface 54 to attach the sensor 10 to a surface. In the illustrated example, the contacts 22 and 24 are conventional tin-plated circuit traces. However, other materials could be used to form the contacts 22 and 24. For example, conductive ink or gold plating could be used to maximize corrosion resistance and life cycle of the contacts 22 and 24. Further, the contacts 22 and 24 could separate from the circuit board 20 from copper, tin or any other suitable contact material and mounted to the circuit board 20 and/or to some other feature within the housing 12 of the sensor 10.

The circuit board 20 also includes a plurality of solder pads 70–76 to which the male connector 68 is soldered. Each of the solder pads 70–76 corresponds to a different one of the four electrical signals (e.g., common ground and three different voltages) provided to the female connector 30. An opening 78 enables the cable 34 and the plurality of wires 36 (which pass through the opening 32 of the housing 12) to pass through the circuit board 20 so that the wires 36 can be soldered to the circuit board 20.

Figure 7:
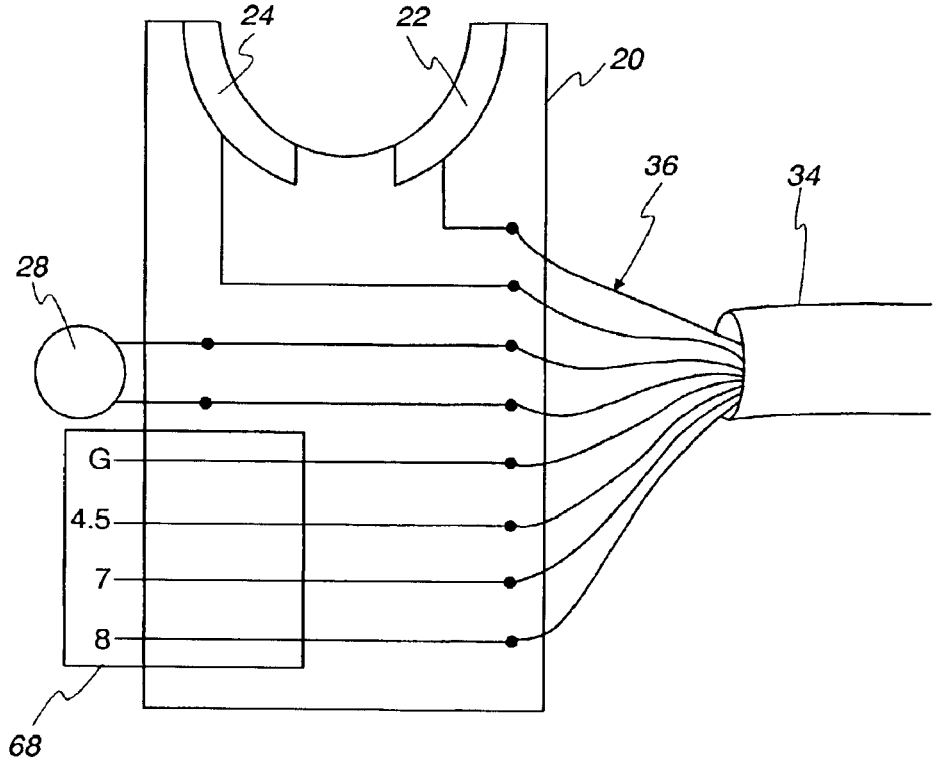
FIG. 7 is a schematic diagram that depicts an example manner in which the wires of the cable may be connected to the contacts, the attachment indicator and the male connector of the sensor shown in FIG. 1.

FIG. 7 is a schematic diagram that depicts an example manner in which the wires 36 of the cable 34 may be connected to the contacts 22 and 24, the attachment indicator 28 and the male connector 68. As shown in FIG. 7, four of the wires 36 are routed via the circuit board 20 to provide a common ground and three different power supply voltages (e.g., 4.5 volts DC, 7 volts DC and 8 volts DC) to the connector 68. Two of the wires 36 are routed to provide power to the indicator 28, when the sensor 10 is not attached to a surface, and two of the wires 36 are routed via the circuit board 20 to enable the contacts 22 and 24 to be routed via the cable 34 to a security monitoring unit or the like that determines if an electrical path exists between the contacts 22 and 24.

Figure 3:
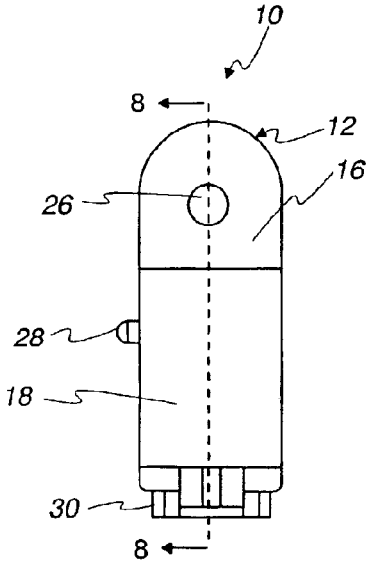
FIG. 3 is a plan view of a bottom side of the example sensor shown in FIG. 1.
Figure 4:
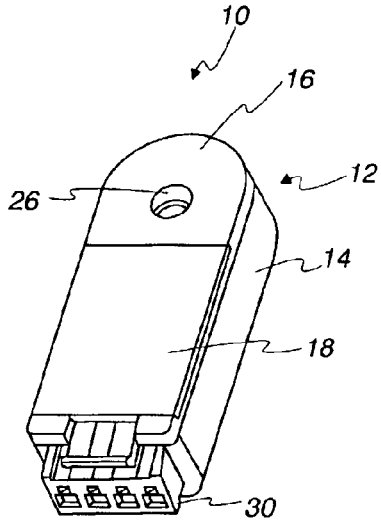
FIG. 4 is an isometric assembly view of the example sensor shown in FIG. 1.
Figure 8:
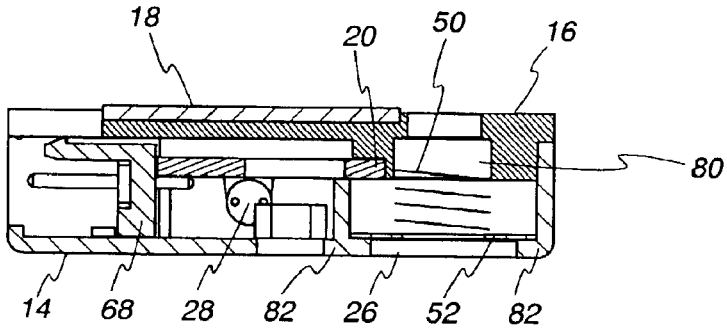
FIG. 8 is a detailed sectional view of the sensor of FIG. 1 taken along line 8—8 depicted in FIG. 3 when the sensor is not attached to a surface.

FIG. 8 is a detailed sectional view of the sensor 10 taken along line 8—8 in FIG. 3 when the sensor 10 is not attached to a surface. As shown in FIG. 8, the spring 50 is retained in an approximately coaxial relationship with the passage 26 by a recess 80. The spring 50 urges the washer 52 away from the contacts 22 and 24 and the circuit board 20 so that no substantially conductive electrical path exists between the contacts 22 and 24. Preferably, the housing 12 includes a lip 82 that retains the washer 52 within the housing 12. A security unit (not shown) coupled to the ones of the wires 36 corresponding to the contacts 22 and 24 will recognize the open electrical path as the sensor 10 not being attached to a surface. Thus, the sensor 10 may have been removed from a device being protected and the security unit may send an electrical signal via another pair of the wires 36 within the cable to illuminate the indicator 28.

Figure 9:
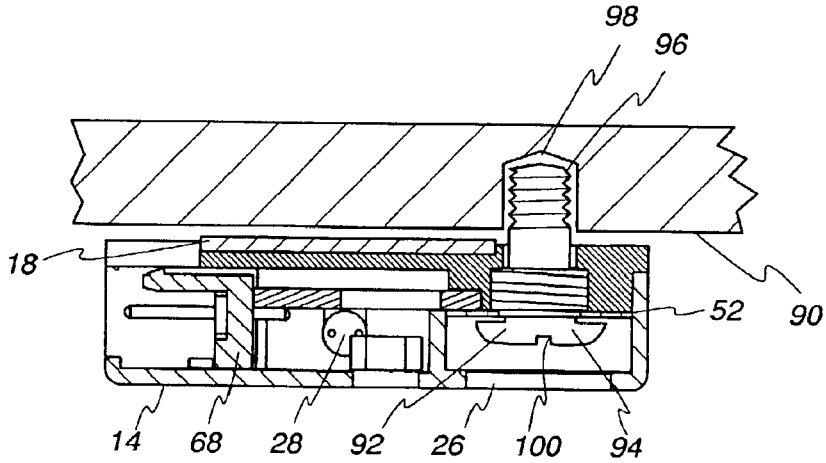
FIG. 9 is another detailed sectional view of the sensor of FIG. 1 taken along line 8—8 depicted in FIG. 3 when the sensor is attached to a surface.

FIG. 9 is a detailed sectional view of the sensor 10 taken along line 8—8 depicted in FIG. 3 when the sensor 10 is attached to a surface 90. The surface 90 may be associated with a product for sale such as an electronic device (e.g., a camcorder, a camera, a PDA or any other device). To attach the sensor 10 to the surface 90, the sensor is pressed against the surface 90 so that the tape 18 adheres the sensor 10 to the surface 90. An elongated member or fastener 92 extends through the passage 26 so that a head portion 94 of the fastener 92 urges the washer 52 against the contacts 22 and 24 on the circuit board 20, thereby forming an electrical path between the contacts 22 and 24 via the washer 52 and the fastener 92 (in the case where the fastener 92 is made of a conductive material). A threaded portion 96 of the fastener 92 is engaged with a threaded aperture 98 to hold the sensor 10 against the surface 90. A security unit (not shown) coupled to the ones of the wires 36 corresponding to the contacts 22 and 24 will recognize the closed electrical path as indicating that the sensor 10 is attached to the surface 90 and will not send an electrical signal via the wires 36 to illuminate or otherwise activate the indicator 28.

In the example of FIG. 9, the fastener 92 includes a slotted recess 100 that enables a standard flat blade screwdriver to be used to attach the sensor 10 to the surface 90. However, other types of drive geometries could be used instead. For example, a Phillips drive recess, a polygonal recess or circumferential geometry (e.g., square, hexagonal, twelve point, etc.) could be used to facilitate attachment of the sensor 10 to the surface via a rotary drive tool (e.g., a hand or electric screwdriver).

Thus, as can be clearly seen from FIGS. 8 and 9, the sensor 10 provides an electrical switch assembly having one or movable members (e.g., the washer 52 and the fastener 92) that are springably biased away from two electrical contacts (e.g., 22 and 24). Attaching the sensor 10 to a surface via an elongated member or fastener (e.g., the fastener 92) that extends through the sensor 10 causes one or both of the movable members to function as a third electrical contact that forms an electrical path between the first and second contacts. Removal of the sensor 10 from the surface re-opens or breaks the electrical path between the first and second contacts, which can be detected by a security system or the like to indicate that a device or product is being stolen, tampered with, etc. Although described as a remote device, the security monitor, unit or system could instead be local. For example, it could be located within the housing 12. In addition, while the indicator 28 is described as being a light-emissive device, it could instead provide a different output such as, for example, an audible output.

Figure 10:
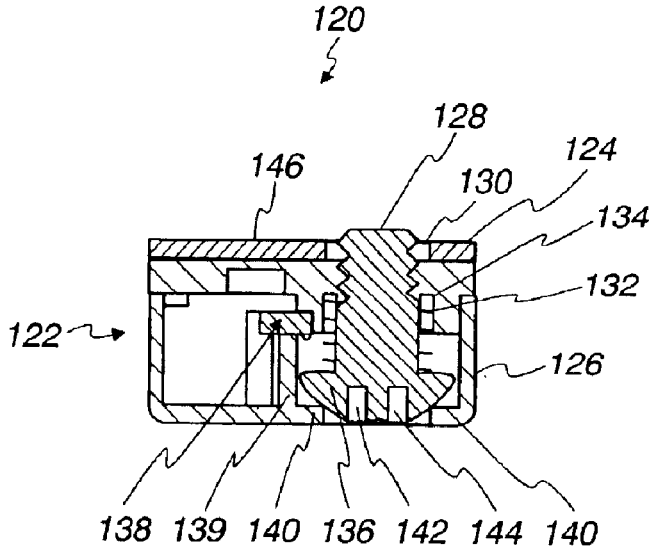
FIG. 10 is a detailed sectional view of another example sensor for detecting attachment to a surface that is not attached to a surface.
Figure 11:
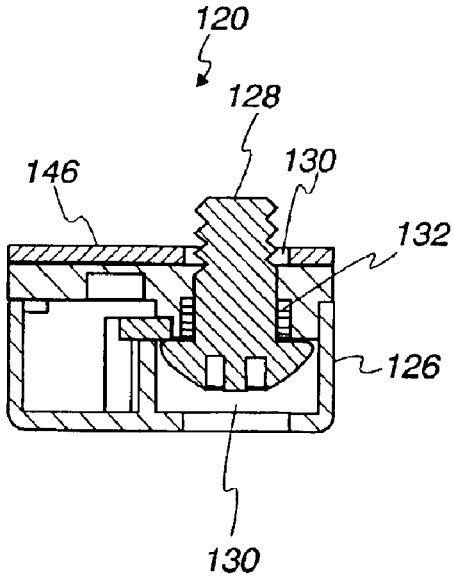
FIG. 11 is another detailed sectional view of the sensor of FIG. 10 when the sensor is attached to a surface.

FIGS. 10 and 11 are detailed sectional views of another example sensor 120 for detecting attachment to a surface. In general, the sensor 120 is similar to the sensor 10. However, the sensor 120 does not include a washer structure (i.e., the washer 52), a connector (e.g., the connector 68) for supplying power to an electronic device or an attachment indicator (e.g., the indicator 28). The sensor 120 includes a two-piece housing 122 having a first portion 124 and a second portion 126 that are joined together using glue, welding and/or fasteners, etc. An elongated member or fastener 128 extends through a passage 130 in the housing 122. A spring 132 is captured in a recess 134 and urges a head portion 136 of the fastener 128 away from first and second electrical contacts 139 disposed on a circuit board 138. A lip or edge 140 of the housing 122 retains the fastener 128 within the housing 122. The example fastener 128 has first and second bores or recesses 142 and 144 that require a special rotary fastening tool (e.g., having two prongs) to be used to fasten or attach the sensor 120 to a surface, thereby minimizing the potential for tampering, removal, etc. by unauthorized persons. The sensor 120 also includes an adhesive layer 146 that facilitates attachment of the sensor 120 to a surface and that further discourages tampering, unauthorized removal, etc. of the sensor 120 from a surface of a device being monitored.

In FIG. 10, the sensor 120 is depicted in a condition where it is not attached to a surface and the head portion 136 of the fastener 128 is separated from the contacts (not shown) on the circuit board 138 so that there is no electrical path between the contacts. In FIG. 11, the sensor 120 is depicted in a condition where it is attached to a surface and the head portion 136 of the fastener 128 is in contact with the printed circuit board 138 and, thus, the contacts, to form an electrical path between the contacts.

The attachment sensor described herein may be used in a variety of applications including retail theft deterrence/prevention, cargo monitoring, equipment tampering, etc. Thus, those having ordinary skill in the art will immediately recognize that the structures and materials described in connection with the examples provided herein may be varied to optimize performance in a particular application for particular environmental conditions. For example, the elongated member or fastener used to attach the sensor to a surface may have any desired fastening mechanism (e.g., threads, barbs, etc) and may be made from any desired materials such as, for example, zinc-plated steel, galvanized steel, gold-plated metal, nylon etc. to suit a particular application. Likewise, the housing of the sensor may be configured in any desired geometry and may be made from any desired material to facilitate attachment of the sensor to particular types of surfaces and/or devices that may be exposed to a variety of different environments.

In any event, while the attachment sensor has been described herein in connection with specific examples, these are not to be construed as limiting the scope of protection of this patent. To the contrary, this patent covers all embodiments fairly falling within the scope of the appended claims either literally or under the doctrine of equivalents.

What is claimed is:

1. A sensor for detecting attachment to a surface, comprising:

a housing having an inner surface, an outer surface and a passage extending through the housing;

a fastener having an elongated portion and a head portion, wherein the elongated portion is sized to extend through the passage and protrude from the outer surface of the housing; and first and second electrical contacts disposed within the housing and between the head portion and the inner surface of the housing so that when the fastener is coupled to the surface to attach the sensor to the surface the head portion of the fastener completes an electrical path between the first and second electrical contacts.

2. The sensor of claim 1, further including a spring disposed between the head portion and the inner surface of the housing to urge the head portion away from the first and second electrical contacts.

3. The sensor of claim 2, wherein the spring is a coil spring that is approximately coaxial with the elongated portion of the fastener and the passage.

4. The sensor of claim 3, wherein the housing includes a recess that retains the spring in an approximately coaxial relationship with the elongated portion of the fastener.

5. The sensor of claim 2, further including a third electrical contact disposed between the head portion of the fastener and the first and second electrical contacts so that when the fastener is coupled to the surface the third electrical contact forms at least a portion of the electrical path between the first and second contacts.

6. The sensor of claim 5, wherein the third electrical contact is a washer.

7. The sensor of claim 1, wherein the housing includes a first portion that is joined to a second portion.

8. The sensor of claim 1, wherein the elongated portion of the fastener includes a threaded portion.

9. The sensor of claim 1, wherein the fastener is made of a conductive material.

10. The sensor of claim 1, wherein the head portion includes one of a slotted recess, a Phillips recess and a polygonal profile for engagement with a rotatable fastening tool.

11. The sensor of 1, wherein the fastener comprises one of a screw and a bolt.

12. The sensor of claim 1, further including a circuit board disposed within the housing, wherein the first and second contacts are integral with the circuit board.

13. The sensor of claim 1, further including an attachment indicator.

14. The sensor of claim 13, wherein the attachment indicator is a light-emitting diode.

15. The sensor of claim 1, further including a connector that is adapted to be coupled to an electronic device associated with the surface.

16. The sensor of claim 15, wherein the connector is a de-pluggable connector.

17. The sensor of claim 1, further including an adhesive layer fixed to the housing, wherein the adhesive layer is adapted to adhere the housing to the surface.

18. The sensor of claim 17, wherein the housing includes an opening sized to accommodate an electrical cable containing a plurality of electrical conductors.

19. A sensor for detecting attachment to a surface, comprising:

a housing having an outer surface;

an elongated member disposed within the housing and having a head portion and a fastening portion adapted to protrude from the outer surface of the housing to fasten the sensor to the surface; and first and second contact surfaces fixed to the housing and opposing the head portion of the elongated member to form a switch within the housing, wherein the switch is closed when the sensor is attached to the surface via the elongated member and open when the sensor is not attached to the surface.

20. The sensor of claim 19, wherein the elongated member comprises one of a bolt and a screw.

21. The sensor of claim 19, wherein the first and second contact surfaces are disposed on a printed circuit board.

22. The sensor of claim 19, further including a spring that urges the head portion of the elongated member away from the first and second contacts.

23. The sensor of claim 19, further including an attachment indicator.

24. The sensor of claim 23, wherein the attachment indicator is a light-emitting diode.

25. The sensor of claim 19, further including a connector that is adapted to be coupled to an electrical sensor associated with the surface.

26. The sensor of claim 19, further including an adhesive layer fixed to the housing, wherein the adhesive layer is adapted to adhere the housing to the surface.

27. A sensor for detecting attachment to a surface, comprising:

a housing having a passage extending through the housing that is sized to accommodate an elongated fastener; and first and second electrical contacts disposed within the housing, wherein the first and second contacts are located to provide an electrical path through the elongated fastener when the elongated fastener is disposed in the passage to attach the sensor to the surface.

28. The sensor of claim 27, wherein the passage is sized to accommodate one of a screw and a bolt.

29. The sensor of claim 28, further including a printed circuit board on which the first and second electrical contacts are disposed.

30. The sensor of claim 27, further including a spring disposed within the housing and configured to urge the elongated fastener away from the surface.

31. The sensor of claim 27, further including an adhesive layer fixed to the housing and adapted to adhere the housing to the surface.

32. An sensor for detecting attachment to a surface, comprising:

a housing having an outer surface and a passage extending through the housing along an axis; and a switch assembly disposed within the housing, wherein the switch assembly has first and second electrical contacts and a springably biased movable member that is displaceable along the axis, and wherein the movable member has an aperture that is approximately coaxial with the passage so that when a fastener extends through the passage to attach the sensor to the surface the movable member is urged toward the first and second electrical contacts to complete an electrical path therebetween.

33. The sensor of claim 32, further including a circuit board on which the first and second electrical contacts are disposed.

34. The sensor of claim 32, further including a coil spring that springably biases the movable member away from the first and second electrical contacts.

35. The sensor of claim 32, further including an attachment indicator that illuminates when the sensor is attached to the surface.

36. A sensor for detecting attachment to a surface, comprising:

means for encasing the sensor and having a passage extending through the encasing means;

means for attaching the sensor to the surface and sized to extend through the passage; and means disposed within the encasing means for sensing when the sensor is attached to the surface by the means for attaching.

37. The sensor of claim 36, further including a means for biasing the sensing means toward an open condition.

38. The sensor of claim 36, further including means responsive to the sensing means for indicating that the sensor is attached to the surface.

39. A method of detecting attachment of a sensor to a surface, comprising:

extending a fastener through the sensor to attach the sensor to the surface;

forming a conductive path through the fastener when the fastener is secured to the surface; and interrupting the conductive path through the fastener if the fastener is at least partially removed from the surface.

40. The method of claim 39, wherein extending the fastener through the sensor to attach the sensor to the surface includes extending a threaded fastener through the sensor and threading the fastener at least partially into the surface.

41. The method of claim 39, wherein forming the conductive path through the fastener when the fastener is secured to the surface includes urging a conductive element into contact with a pair of contacts.

42. The method of claim 39, further including providing an output indicating when the fastener is at least partially removed from the surface.

* * * * *